US010549900B2

(12) United States Patent
McCormick

(10) Patent No.: US 10,549,900 B2
(45) Date of Patent: Feb. 4, 2020

(54) INSULATED STORAGE AND TRANSPORT SYSTEM

(71) Applicant: Savsu Technologies LLC, Old Bethpage, NY (US)

(72) Inventor: Bruce McCormick, Sante Fe, NM (US)

(73) Assignee: SAVSU TECHNOLOGIES LLC, Old Bethpage, NY (US)

( * ) Notice: Subject to any disclaimer, the term of this patent is extended or adjusted under 35 U.S.C. 154(b) by 841 days.

(21) Appl. No.: 15/165,551

(22) Filed: May 26, 2016

(65) Prior Publication Data

US 2016/0347532 A1 Dec. 1, 2016

Related U.S. Application Data

(60) Provisional application No. 62/166,660, filed on May 26, 2015.

(51) Int. Cl.
*B65D 81/38* (2006.01)
*B65D 85/50* (2006.01)

(52) U.S. Cl.
CPC ..... *B65D 81/3827* (2013.01); *B65D 81/3816* (2013.01); *B65D 85/50* (2013.01)

(58) Field of Classification Search
CPC ..... B65D 81/3823; B65D 81/3816; B65D 81/3827; B65D 85/50; F25D 3/06; F25D 2303/085; C09K 5/08
See application file for complete search history.

(56) References Cited

U.S. PATENT DOCUMENTS 3,395,581 A * 8/1968 Spipin ..... G01L 9/0095 73/753
2007/0186577 A1* 8/2007 Goncharko ..... B65D 81/3858 62/371
2012/0156002 A1* 6/2012 Maruhashi ..... B65D 81/3816 414/800
2013/0020309 A1* 1/2013 Tattam ..... B65D 81/18 219/441

FOREIGN PATENT DOCUMENTS

JP 2001330351 A * 11/2001

* cited by examiner

*Primary Examiner* — Frantz F Jules
*Assistant Examiner* — Martha Tadesse
(74) *Attorney, Agent, or Firm* — Reising Ethington P.C.

(57) ABSTRACT

A thermal storage system includes a thermally insulated storage container and a payload container adapted to retrievably house a temperature sensitive payload. The system includes layers of first and second phase change materials arranged in a stack with the payload container. The first phase change material has a phase change temperature within a target temperature range of the payload, and the second phase change material has a phase change temperature outside the target temperature range. The layers are arranged to isolate the payload from the second phase change material. In the case of biological materials that must not freeze while stored in the container, this arrangement enables a cold pack containing the layers of phase change materials to be placed in direct contact with the contents container even with a cold pack starting temperature well below the freezing point of the contents.

20 Claims, 1 Drawing Sheet

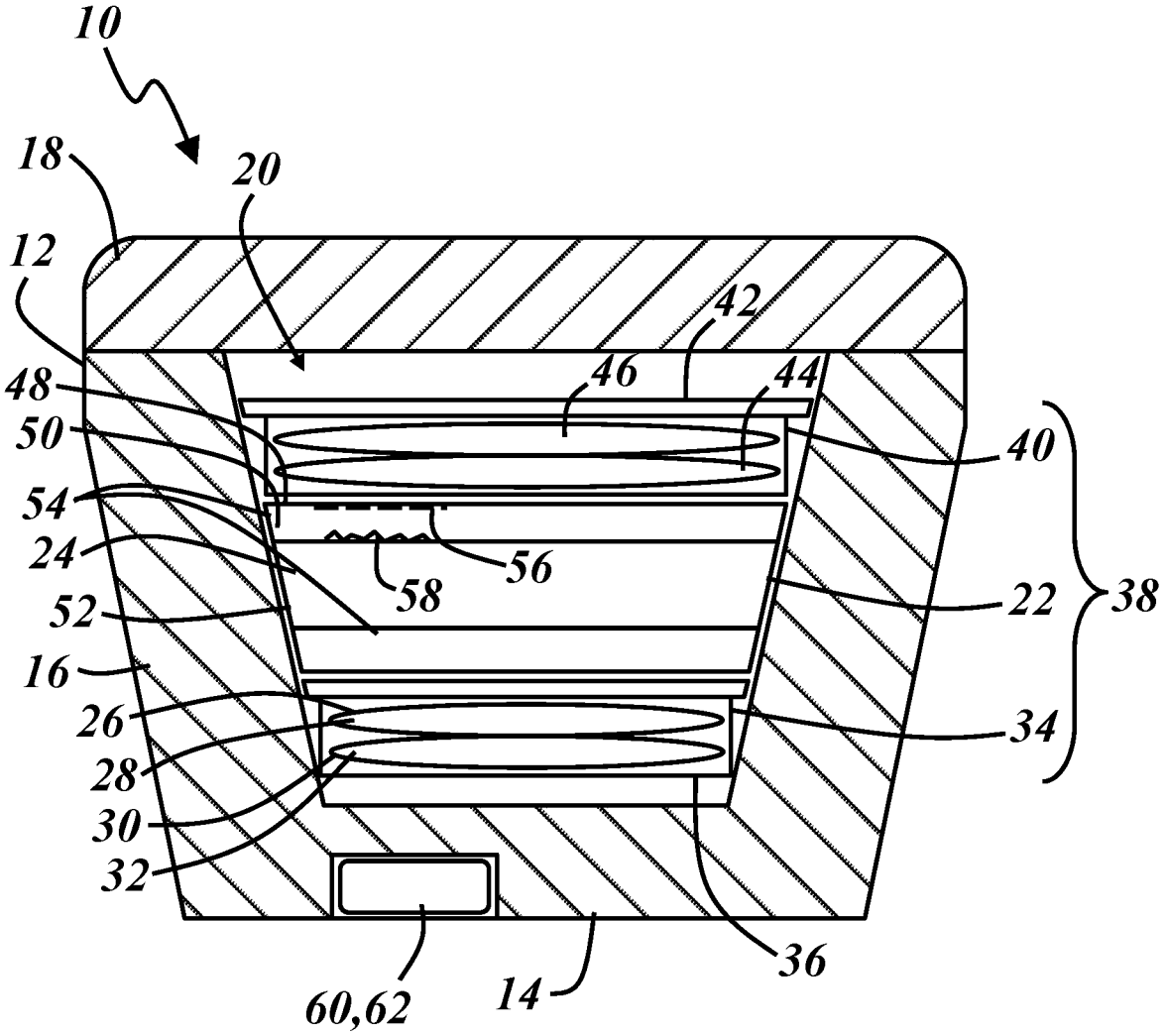
10
18
20
12
42
46
44
48
50
40
54
56
24
58
22
38
52
16
26
34
28
30
32
36
60,62
14

INSULATED STORAGE AND TRANSPORT SYSTEM

TECHNICAL FIELD

The present disclosure relates generally to storage containers and methods of storing and transporting temperature sensitive items.

BACKGROUND

Transport of biological materials for the treatment of disease is becoming more common. These materials are often extremely temperature sensitive. Conventional shipping methods include the use of insulated containers and some form of thermal mass. One of the challenges encountered during the shipping of such temperature sensitive materials is inadvertent freezing or overheating of the materials, which may result in the effective destruction of the materials. One of the causes for excursions below and above acceptable temperature limits is inappropriate pack-out materials and procedures.

Another problem with the transport of temperature sensitive disease-treating materials is the absence of relevant data relating to the condition of the materials during transit. For example, the personnel administering the treatment has no assurance that the materials did not become too cold or too hot during transit and cannot risk using the materials due to the absence of a temperature history for the materials. Other important data can include humidity, atmospheric pressure, light exposure, location, and/or shock and vibration history.

In many cases, the transport of such biological materials can be divided into two distinct transport segments. The first transport segment begins with shipment from a laboratory or other material supplier and ends at a treatment facility. This first transport segment may include long distance air transport, which may be an international transport. The duration of this first transport segment may range from 24 to 96 hours. The second transport segment includes transport of the biological material within the treatment facility. This second segment may include removal of the temperature sensitive material from the insulated shipping container used for the first transport segment and transport to the actual point of use of the material, where the material is infused or administered to a patient. This second transport segment may range anywhere from 30 minutes to 24 hours.

SUMMARY

In accordance with one or more embodiments, a thermal storage system includes a thermally insulated storage container comprising one or more walls that together define an enclosed volume, a payload container sized to fit within the enclosed volume and having a payload volume adapted to retrievably house a temperature sensitive payload having a target temperature range, a layer of a first phase change material having a phase change temperature within the target temperature range the payload container comprising, and a layer of a second phase change material having a phase change temperature outside the target temperature range. The layer of the first phase change material is located between the payload volume and the layer of the second phase change material to prevent the second phase change material from causing the temperature sensitive payload to reach a temperature outside the target temperature range.

In accordance with one or more embodiments, a thermal storage system includes a thermally insulated storage container comprising one or more walls that together define an enclosed volume, a payload container sized to fit within the enclosed volume and having a payload volume adapted to retrievably house a temperature sensitive payload having a target temperature range, a small phase change pack comprising a layer of a first phase change material having a phase change temperature within the target temperature range and a layer of a second phase change material having a phase change temperature outside the target temperature range, and a large phase change pack comprising a layer of the first phase change material and a layer of the second phase change material. The payload container and phase change packs fit within the enclosed volume of the thermally insulated storage container only when arranged in a stack with the payload container between the phase changes packs with each of the layers of the first phase change material located between the payload volume and a respective one of the layers of the second phase change material.

BRIEF DESCRIPTION OF THE DRAWINGS

One or more embodiments will hereinafter be described in conjunction with the appended drawings, wherein:

FIG. 1 is one example of a thermal storage system for use in storing and/or transporting temperature sensitive payload materials.

DESCRIPTION OF ILLUSTRATIVE EMBODIMENTS

One cause of dangerous conditions for biological materials used in the treatment of diseases or other medical conditions is a temperature excursion during transport. Temperature excursions can be caused by conventional pack-out procedures and/or shipping containers which have proven to be improper or inadequate. Further, conventional shipping containers do not include any provision for raising an alert that a temperature excursion has been experienced by the temperature sensitive materials. An additional cause of temperature excursions is lack of appropriate transport of the temperature sensitive materials within the treatment facility, such as a hospital, which may be administering the material to a critically ill patient. In these circumstances minutes count, and a continuous stream of data relating to the whereabouts of the material and other data related to the condition of the material, such as the temperature of the material, may be critical for a successful treatment.

Described below is a thermal transport and storage system that uses specially configured phase change packs, such as cold packs, and a payload container used with a super-insulated or other thermally insulated container. The system may include a communication device and/or a data collection device embedded in the insulated container. The communication device may be a wireless device, such as a short-range wireless communication device. The system may also include a countdown timer embedded or otherwise attached to the insulated container, which can be used within the treatment facility, such as after the payload container is removed from the insulated container. The data collection device can provide information, such as temperature information from a temperature probe in the payload container, to the wireless device to be communicated to an external receiving device, such as a cloud based portal, where the data can be stored for permanent record keeping and for real time monitoring of the transport system.

A non-limiting example of a thermal storage system 10 is illustrated in FIG. 1. The illustrated system 10 includes a thermally insulated storage container 12 comprising one or more walls 14, 16, 18 that together define an enclosed volume 20. One or more or all of the walls 14, 16, 18 may include a layer of super-insulating material or panel such as an aerogel material or a microporous material or a vacuum panel. As used herein, a super-insulating material or panel is any material or panel that has a thermal conductivity of less than 0.02 W/m-K. Super-insulating materials or elements are a subset of insulating materials such that all super-insulators are insulators, but not all insulators are super-insulators. The walls of the insulated container may include or be formed from other non-super-insulators, such as expanded polystyrene or polyurethane foam, for example.

The thermal storage system 10 includes a payload container 22 sized to fit within the enclosed volume 20. The payload container 22 includes a payload volume 24 adapted to retrievably house (e.g., via a closure that can be opened and closed) a temperature sensitive payload having a target temperature range. An exemplary temperature range for biological materials is from 2° C. to 8° C., but other temperature ranges are applicable.

The system further includes a layer 26 of a first phase change material 28 having a phase change temperature within the target temperature range of the payload, along with a layer 30 of a second phase change material 32 having a phase change temperature outside the target temperature range of the payload. The layer 26 of the first phase change material is located between the payload volume 24 and the layer 30 of the second phase change material to prevent the second phase change material from causing the temperature sensitive payload to reach a temperature outside the target temperature range. For example, the second phase change material may be water with a phase change temperature of 0° C., which is too cold for a biological material having a target temperature range from 2° C. to 8° C. The first phase change material thus protects the payload from freezing when the second phase change material is solid or changing phase. For example, the first phase change material may have a phase change temperature of about 5° C. Some examples of suitable first phase change materials include certain hydrocarbon-based materials and materials including salt hydrates. A particular example of a suitable first phase change material can be obtained as part of a cool pack available in the savEnrg™ product line (RGEES, LLC, Arden, N.C., USA).

In the illustrated example, the system 10 includes a first phase change pack 34, such as a cold pack, comprising a hollow shell 36 and the layers 26, 30 of first and second phase change materials inside the hollow shell. The payload container 22 and the first phase change pack 34 are sized and shaped such that, when placed in contact with each other in a stack 38, the stack fits in the enclosed volume 20 of the thermally insulated storage container in a single orientation in which both the payload container and the first phase change pack have a close fit with the walls 16 of the thermally insulated storage container at opposite sides of the enclosed volume, as shown.

The system 10 may also include a second phase change pack 40, such as a second cold pack 40, comprising a hollow shell 42, a layer 44 of the first phase change material, and a layer 46 of the second phase change material inside the hollow shell 42. The payload container 22, the first phase change pack 34, and the second phase change pack 40 are sized and shaped such that, when placed in contact with one another in the stack 38, the stack fits in the enclosed volume 20 of the thermally insulated storage container in a single configuration in which each of the payload container and the first and second phase change packs has a close fit with the walls 16 of the thermally insulated storage container at opposite sides of the enclosed volume. In this single configuration, the payload container 22 is located between the first and second phase change packs 34, 40 with each one of the layers 30, 46 of the second phase change material isolated from the payload container 22 by one of the layers 26, 44 of the first phase change material, as shown in FIG. 1.

In this example, the walls of the thermally insulated storage container comprise a base 14 and one or more sidewalls 16 extending away from the base 14 such that the distance between opposite sides of the enclosed volume increases with increasing distance from the base. The largest dimension of the payload container is different from the largest dimension of the phase change packs for a properly configured stack.

The individual layers of phase change materials may each be self-contained. For example, each of the phase change materials may be contained in a plastic pouch or other container to prevent rearrangement, mixing, or settling of the first and second phase change materials with respect to each other.

The system may further include one or more layers 48 of a third phase change material 50 located between the payload volume 24 of the payload container 22 and the layer(s) of the second phase change material. The third phase change material 50 may have a phase change temperature within the target temperature range. Certain benefits of this arrangement are discussed further below. In one example, the first and third phase change materials have the same phase change temperature. In some cases, the first phase change material is the same material as the third phase change material. The payload container 22 may be constructed to include the layer(s) of the third phase change material, as shown, so that each layer of the third phase change material is located between one of the layers of the first phase change material and the payload volume.

The illustrated payload container 22 comprises a housing 52 that defines the payload volume 24 and one or more cavities 54 in which each layer of the third phase change material is contained. In some embodiments, the housing 52 of the payload container includes an inspection window 56 (shown as a dashed line in FIG. 1) through which the layer of the third phase change material is visible in the cavity when the window is not obstructed by a phase change pack or sealed in the insulated container. When so equipped, the system 10 may also include indicia 58 located inside the cavity of the payload container and on an opposite side of the cavity from the inspection window. The indicia may thus be visible via the inspection window when the third phase change material is liquid and not visible through the inspection window when the third phase change material is solid. An example of indicia includes a colored indicator (e.g., a green stripe or label) or some form of symbols or text.

The payload container 22 may also include an opening (not shown in FIG. 1) adapted to accommodate a temperature probe for measuring the temperature inside the payload volume where the temperature sensitive contents are stored. The system may also include a shock absorbing material located within the payload volume 20 and arranged to at least partly isolate the temperature sensitive payload from shock or vibration experienced by the thermally insulated storage container. One example of a shock absorbing material is a portion of foam or rubber material with slits or recesses for securing vials or other smaller containers in position within the payload volume.

The thermal storage system 10 may also include a wireless communication device 60 and/or a data storage device 62. The communication device is adapted to communicate information about the storage system to a receiving device separate from the storage system via known communication protocols. The data storage device 62 is adapted to retrievably store information about the storage system, such as payload volume temperature, system location, pressure, humidity, elapsed time, etc. In the illustrated example, the communication and data storage devices 60, 62 are combined into a single electronic unit fitted into a recess in the base 14 of the thermally insulated container, but they may also be separate units. The system 10 may also include a power supply, such as a battery pack (not shown) and/or various wires or cables interconnecting electronic devices with the power supply and/or sensors (e.g., a temperature sensor, pressure sensor, or accelerometer).

As arranged in FIG. 1, the first phase change pack 34 is a small phase change pack and is configured to fit at a first or bottom end of the enclosed volume 20 of the thermally insulated container 12. The second phase change pack 40 is a large phase change pack and is configured to fit at a second or top end of the enclosed volume 20 of the thermally insulated container 12 on the opposite side of the payload container 22 from the small phase change pack 34. The illustrated stack configuration, with the small cold pack 34 at the bottom, the large cold pack 40 at the top, and the payload container 22 between the two cold packs 34, 40, is the only stacked arrangement of the stack 38 of components 22, 34, 40 that will fit into the enclosed volume 20. This is due in part to the shape of the enclosed volume 20 of the thermally insulated container 12, in which the second or top end has a larger dimension (e.g., the distance between opposing wall portions) than the first or bottom end.

Each of the phase change packs 34, 40 and, more particularly, the hollow shell of each of the phase change packs, also has a first or bottom end and a second or top end with a larger dimension than the first end such that the stack 38 will not fit in the enclosed volume 20 of the thermally insulated storage container 12 if one or both of the phase changes packs 34, 40 is oriented with its respective layer of the second phase change material between the payload volume 24 and its respective layer of the first phase change material. In other words, as illustrated, if either of the phase change packs 34, 40 of FIG. 1 is placed in the insulated storage container 12 upside down with the respective layers of different phase change materials improperly arranged, the stack 38 will not fit in the enclosed volume 20 of the storage container 12—i.e., the top wall 18 of the container 12 will not fit onto the sidewalls 16 of the storage container to define the enclosed volume. This is true for the illustrated payload container 22 as well. The illustrated payload container 22 obtains its one-way configuration in part from the tapered side walls of the housing of the payload container. The illustrated phase change packs 34, 40 each have a flange or rim at the second larger end of the hollow shells to give that end its larger dimension with respect to the first smaller end.

An exemplary method of using the thermal storage system 10 includes the step of stacking a layer of the first phase change material between the payload container 22 and a layer of the second phase change material in the enclosed volume 20 of the thermally insulated storage container 12. The method may further include the step of stacking an additional layer of the first phase change material between the payload container 22 and an additional layer of the second phase change material in the enclosed volume 20 of the thermally insulated storage container 12 such that one of the layers of each of the phase change materials is located at opposite sides of the payload container as shown in FIG. 1.

The method may further include placing the phase change packs 34, 40 in the enclosed volume 20 of the thermally insulated storage container 12 while both of the first and second phase change materials are solid. For example, the phase change packs 34, 40 may be obtained from an environment (e.g. a freezer) having a temperature of −20° C., at which temperature both the first phase change material (e.g. having a phase change temperature between 2° C. and 8° C.) and the second phase change material (e.g. water) are in the solid phase and cold enough to remain solid during the step of stacking.

The method may further include placing the temperature sensitive payload in the payload volume 24 while the payload is within the target temperature range and the payload container is within or above the target temperature range. For example, the payload may be obtained from an environment having a temperature between 2° C. and 8° C. (e.g., 5° C.) and placed into the payload container 22, which may be obtained from an environment having a temperature between 2° C. and 8° C. (e.g., 5° C.) or above.

The method may further include the step of monitoring the temperature of the payload volume 24, or some other characteristic noted above for the thermal storage system 10, after the step of stacking and during transport of the thermally insulated storage container 12 from one location to another location, such as during one or both of the aforementioned first or second transport segments. Certain other features and advantages of the thermal storage system 10 are described below.

The hollow shell of each phase change pack may be constructed of a durable plastic or metal material. Inside each shell there may be a combination of at least two different phase change materials. The different phase change materials may have different enthalpies as well as phase change temperatures (i.e. freezing points). The volume of each layer of phase change material and the orientation of the phase change materials within each pack 34, 40 and within the stack 38 are at least partly responsible for enabling temperature control as desired during shipment.

In an exemplary arrangement of phase change packs 34, 40, like phase change materials are placed adjacent the payload container 22, with the top pack 40 having a 5° C. phase change material at its bottom and the bottom pack 34 having a 5° C. phase change material at its top, thereby sandwiching the payload container 22 between layers 5° C. phase change materials. Each hollow shell may also be configured with a removable or openable closure to change out phase change material pouches as desired.

One of the advantages of this exemplary construction is enablement of a simple one-step process of freezing the cold packs 34, 40 in a conventional freezer, at approximately −20° C., for example. Due to the different freezing points and the different specific heats of the phase change materials contained within each cold pack 34, 40, and the controlled relative location of the phase change materials within each cold pack, a managed heat flow between the cold packs and the payload container 22 results, as well as a desired temperature within the payload container.

One specific objective enabled by the system 10 is the enablement of direct placement of cold packs 34, 40 inside the enclosed volume 20 of the storage container 12 while at an otherwise dangerous temperature (e.g., −20° C.) even when the desired payload temperature may be 5° C. The conventional process for the use of cold packs which are frozen at −20° C. is to (precondition) the cold packs by removing them from the freezer and allowing them to remain at room temperature for some period of time to warm the cold packs from −20° C. to approximately 0° C. prior to placement in the insulated container. This preconditioning process is a long-felt and unresolved problem in the art and sometimes leads to inadvertent freezing of the payload when the cold pack is not properly preconditioned to the desired temperature of 0° C. For instance, a cold pack may conventionally be placed into a shipping container with the temperature sensitive payload at a temperature at or near the freezer temperature of −20° C., in which case the payload may freeze. Or the cold pack may be preconditioned for excessive time, resulting in partial or complete melting of the phase change material in the cold packs, a warmer than desired storage temperature, and/or a shorter than desired period of safe shipping time at the desired payload temperature. The conventional technique of preconditioning cold packs results in non-standardized practices and interjects performance variability into the pack-out process for the shipment of temperature sensitive products.

The payload container 22 may be shaped and sized to fill the portion of the enclosed volume 20 of the storage container 12 between the top and bottom phase change packs 40, 34. The illustrated payload container 22 includes built-in thermal buffers at its top and bottom in the form of the layers 54 of the third phase change material. These layers 54 of thermal buffer are each in a cavity and contain a specific volume of the phase change material. This phase change material has a known enthalpy. When the payload container 22 is positioned within the thermally insulated storage container 12 sandwiched between the top and bottom cold packs 40, 34, the thermal buffers at the opposite sides of the payload container 22 are in direct physical contact with the bottom of the top cold pack 40 and the top of the bottom cold pack 34. This arrangement effectively manages heat flow between the payload container 22 and the cold packs 34, 40 in a calculated and predictable manner. Within a controlled environment such as the volume 20 of the thermally insulated storage container 12, which itself has a known resistance to heat flow between the enclosed storage volume and the external environment, and also knowing what the temperature, mass, and enthalpy of the cold packs 34, 40 and payload container 22 which will be placed inside the insulated container 12, the heat flow between all of the system components can be calculated to result in the payload volume 24 being maintained within the target temperature range.

A more detailed exemplary method consistent with that described above includes the following steps:

Step 1—Freeze the top and bottom cold packs in a conventional freezer at about −20° C. for a minimum period required for equilibrium prior to placement of the cold packs in the insulated container;

Step 2—Store the insulated container at room temperature for a minimum period required for equilibrium prior to pack-out;

Step 3—Store the payload material in a refrigerator at the desired storage temperature, such as about 5° C.;

Step 4—Store the payload container in a refrigerator at a temperature at or above the desired payload temperature, such as about 5° C.;

Step 5—Place the payload into the volume of the payload container;

Step 6—Remove the top and bottom cold packs from the freezer;

Step 7—Place the bottom cold pack into the insulated storage container;

Step 8—Place the payload container into the insulated storage container on top of the bottom cold pack;

Step 9—Place the top cold pack into the insulated storage container on top of the payload container;

Step 10—Close the shipping container and proceed with standard shipping process.

There are generally three phases of heat flow that occur between the time of pack-out and the time the temperature of the payload exceeds the desired storage temperature in a system where it is desired to store the payload at a temperature lower than the external environment.

The first phase, or first specific heat phase, starts at the time of the initial pack-out and ends at the time when the temperatures of the phase change materials reach their melting points.

The second phase, or latent heat phase, starts at the end of the first phase and ends when the phase change materials have completely changed from the solid to the liquid phase.

The third phase, or second specific heat phase, starts at the end of the latent heat phase. During this phase, the phase change materials increase in temperature, and the payload volume eventually reaches a temperature higher than the target temperature range.

In a specific example, the top cold pack includes two separate phase change materials. One material is water contained within a plastic pouch and positioned above the other phase change material. The other phase change material comprises a hydrocarbon material and is also in a plastic pouch. The freezing point for water is 0° C., and water has an enthalpy of 334 kJ/kg-K. Water has a specific heat of 2.03 kJ/kg-K when solid and a specific heat of 4.05 kJ/kg-K when liquid. The other phase change material comprising a hydrocarbon may have a freezing point of about 5° C. and an enthalpy of 190 kJ/kg-K. This other phase change material may have a specific heat of 0.9 kJ/kg-K as a solid and a known specific heat as a liquid. The purpose of arranging these phase change materials within the cold pack in this top and bottom arrangement is to effect an optimal heat exchange between the individual phase change materials with the insulated container and also with the payload container within the insulated container.

In this specific example, the bottom cold pack also includes two separate phase change materials just as in the top cold pack. The difference between the top and bottom cold packs is the orientation or relative location of the different phase change materials: they are inverted with respect to each other. The hydrocarbon-based phase change material is located at the top of the bottom cold pack and is thereby in direct thermal communication with the payload container.

In the above example of the 10-step pack-out process the cold packs are frozen at −20° C. As a result, both of the phase change materials within the cold packs are at −20° C. upon removal from the freezer. The cold packs can be placed directly into the insulated container. Therefore, it can be assumed that the temperature of each phase change material upon placement in the insulated container will be −20° C.

The heat flow into the top cold pack and into each phase change material may be explained as follows. The starting temperature of each phase change material is −20° C. On pack-out, each phase change material rapidly begins to absorb heat from the interior of the insulated container. In particular, the phase change materials absorb the heat from the materials of the insulated container, which they are in direct contact with, more rapidly. This results in the bottom phase change material of the top cold pack absorbing heat from the top of the payload box, which is in direct contact with the bottom of the top cold pack. The top phase change material of the top cold pack can be in direct contact with the top of the insulated container. The initial heat flow from each of the phase change materials will be a function of the heat capacity of each phase change material. The bottom phase change material (i.e. hydrocarbon) of the top cold pack has a very low heat capacity, which results in the temperature of this bottom phase change material rising rapidly to the point of its phase change temperature, which is 5° C. in this example. The top phase change material (i.e. water) of the top cold pack has a much greater heat capacity, which results in a slower rise in temperature up to its freezing point of 0° C.

The heat flow into the bottom cold pack will be identical to that of the top cold pack with the only difference being the top phase change material is the 5° C. phase change hydrocarbon, and the bottom phase change material is water, resulting in the rapid warming of the top phase change material which is in direct contact with the payload container and the slower warming of the bottom phase change material.

The cold packs having a starting temperature of −20° C. rapidly begin to absorb thermal energy from the interior walls of the insulated container, thereby lowering the temperature of the enclosed volume of the insulated container. Thermal energy from the payload container, which has a starting temperature equal to or greater than 5° C., also begins to flow from the payload container to the top and bottom cold packs. The rate of heat flow from the payload container is buffered in two manners: first by the heat the payload container absorbs through the sidewalls of the insulated container, and second by the phase change material in the cavities at the top and bottom of the payload container, which freezes at 5° C. Therefore, once the payload container approaches and reaches 5° C., the phase change materials (PCM) in the top and bottom of the payload container require a dramatically increased amount of additional thermal energy (i.e., the latent heat of the phase change material) before the temperature of the payload container and its payload volume will drop below the phase change temperature of the PCM, which is 5° C. in this example. Given the fact that the heat capacity of the contacting phase change material in the top and bottom cold packs is extremely low, the payload temperature can thereby be prevented from ever dropping below the phase change temperature of the phase change material contained within the top and bottom of the payload container.

During this first phase, the net heat flow out of the payload box to the adjacent cold packs and to the outside of the insulated container will never overcome the heat loss necessary for the phase change materials of the payload container to change phase from liquid to solid. As a result, the payload temperature will equilibrate at the phase change temperature of 5° C.

The second (or latent) phase of heat flow is the longest phase during the course of shipment or storage of the system. In this phase, the cold pack phase change materials have already warmed to their phase change temperatures. The water temperature has risen from −20° C. to 0° C., and the hydrocarbon temperature has risen from −20° C. to 5° C. to reach this second phase. During this phase, the temperature of the payload container, its volume, and the contents in the volume, equilibrates to a stable 5° C.

During the third phase of heat flow, while the phase change materials are liquid and increasing in temperature, the temperature of the payload will increase in parallel with the temperature of the phase change materials.

The payload container may be refrigerated at a minimum temperature of 5° C. prior to being loaded with the payload. To ensure that the payload container is at a temperature in excess of 5° C., the payload container may be fitted with a visual indicator, such as the above described indicia, which can inform a user if the temperature is above or below the desired temperature. Where the indicia is green, for example, if the user sees green through the inspection window, then the user can proceed to load the payload container with the payload. If the indicator is white, in one example, then the user should warm the payload container until the indicator changes to the desired green color.

Once the payload container is properly packed-out, the user may then remove the cold packs from the freezer and place them in the insulated container along with the payload container, close the insulated container, and initiate shipment to the desired destination.

Upon the receipt of the shipped insulated container, the recipient can open the insulated container and remove the payload container. At this time, the recipient may either deliver the payload container to personnel for administration of the payload to a patient, or place the payload container in a refrigerator. In each case, the payload container becomes a stand-alone temperature sensitive shipping container for local intrafacility transportation, during which the objective is to continue to ensure maximum temperature stability of the payload up until the time of use. An additional feature of the above-described system is that the payload temperature and the exact location of the payload within the facility may be continuously monitored and reported via a combination of one or more communication methods employed by the system. Communication methods which the above-described communication device of the thermal storage system may employ include Bluetooth™, Wi-Fi, and Near-Field Communication transmissions. Other known wireless communication techniques may also be employed, such as cellular or other commonly used telephone or smartphone communication techniques.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A thermal storage system, comprising:

a thermally insulated storage container comprising one or more walls that together define an enclosed volume;

a payload container sized to fit within the enclosed volume, the payload container comprising a payload volume adapted to retrievably house a temperature sensitive payload having a target temperature range; and a phase change pack comprising a layer of a first phase change material having a phase change temperature within the target temperature range and a layer of a second phase change material having a phase change temperature outside the target temperature range, wherein the layer of the first phase change material is located between the payload volume and the layer of the second phase change material to prevent the second phase change material from causing the temperature sensitive payload to reach a temperature outside the target temperature range, and wherein the payload container and the phase change pack are sized and shaped such that, when placed in contact with each other in a stack, the stack fits in the enclosed volume of the thermally insulated storage container in only one orientation in which both the payload container and the phase change pack have a close fit with the one or more walls of the thermally insulated storage container at opposite sides of the enclosed volume.

2. The thermal storage system as defined in claim 1, wherein the phase change pack comprises a hollow shell and the layers of first and second phase change materials are inside the hollow shell.

3. The thermal storage system as defined in claim 2, wherein the phase change pack is a first phase change pack, the thermal storage system further comprising:

a second phase change pack comprising a hollow shell, a layer of the first phase change material, and a layer of the second phase change material inside the hollow shell of the second phase change pack, wherein the payload container, the first phase change pack, and the second phase change pack are sized and shaped such that, when placed in contact with one another in a stack, the stack fits in the enclosed volume of the thermally insulated storage container in a single configuration in which each of the payload container and the first and second phase change packs has a close fit with the one or more walls of the thermally insulated storage container at opposite sides of the enclosed volume, and in which the payload container is located between the first and second phase change packs with each one of the layers of the second phase change material isolated from the payload container by one of the layers of the first phase change material.

4. The thermal storage system as defined in claim 1, wherein the one or more walls of the thermally insulated storage container comprise a base and one or more sidewalls extending away from the base such that a distance between opposite sides of the enclosed volume increases with increasing distance from the base, and a largest dimension of the payload container is different from a largest dimension of a phase change pack that includes the layer of the first phase change material and the layer of the second phase change material.

5. The thermal storage system as defined in claim 1, wherein the target temperature range is from 2° C. to 8° C. and the second phase change material is water.

6. The thermal storage system as defined in claim 1, wherein the first phase change material comprises a hydrocarbon or a salt hydrate.

7. The thermal storage system as defined in claim 1, wherein the layer of the first phase change material and the layer of the second phase change material each comprises a pouch containing the respective phase change materials.

8. The thermal storage system as defined in claim 1, further comprising a layer of a third phase change material located between the payload volume and the layer of the second phase change material.

9. The thermal storage system as defined in claim 8, wherein the first and third phase change material have the same phase change temperature.

10. The thermal storage system as defined in claim 1, wherein the payload container comprises a housing that defines the payload volume and a cavity in which a layer of a third phase change material is contained, the housing comprising an inspection window through which the layer of the third phase change material is visible.

11. A thermal storage system, comprising:

a thermally insulated storage container comprising one or more walls that together define an enclosed volume;

a payload container sized to fit within the enclosed volume, the payload container comprising a payload volume adapted to retrievably house a temperature sensitive payload having a target temperature range;

a layer of a first phase change material having a phase change temperature within the target temperature range; and a layer of a second phase change material having a phase change temperature outside the target temperature range, wherein the layer of the first phase change material is located between the payload volume and the layer of the second phase change material to prevent the second phase change material from causing the temperature sensitive payload to reach a temperature outside the target temperature range, wherein the payload container comprises a housing that defines the payload volume and a cavity in which a layer of a third phase change material is contained, the housing comprising an inspection window through which the layer of the third phase change material is visible, the thermal storage system further comprising indicia located inside the cavity and on an opposite side of the cavity from the inspection window, whereby the indicia is visible through the inspection window when the third phase change material is liquid and not visible through the inspection window when the third phase change material is solid.

12. The thermal storage system as defined in claim 1, wherein the payload container further comprises first and second cavities on opposite sides of the payload volume with a layer of a third phase change material in each of the cavities, the third phase change material having a phase change temperature within the target temperature range.

13. The thermal storage system as defined in claim 1, wherein the payload container comprises an opening adapted to accommodate a temperature probe adapted for measuring a temperature inside the payload volume.

14. The thermal storage system as defined in claim 1, further comprising a wireless communicator adapted to communicate information about the thermal storage system to a receiver separate from the storage system.

15. The thermal storage system as defined in claim 1, further comprising a data logger to retrievably store information about the thermal storage system.

16. The thermal storage system as defined in claim 1, wherein at least one of the one or more walls comprises a material having a thermal conductivity of less than 0.02 W/m-K.

17. A thermal storage system, comprising:

a thermally insulated storage container comprising one or more walls that together define an enclosed volume;

a payload container sized to fit within the enclosed volume, the payload container comprising a payload volume adapted to retrievably house a temperature sensitive payload having a target temperature range;

a first phase change pack comprising a layer of a first phase change material having a phase change temperature within the target temperature range and a layer of a second phase change material having a phase change temperature outside the target temperature range; and a second phase change pack that is larger than the first phase change pack, the second phase change pack comprising a layer of the first phase change material and a layer of the second phase change material, wherein the payload container and phase change packs fit within the enclosed volume of the thermally insulated storage container only when arranged in a stack with the payload container between the phase changes packs with each of the layers of the first phase change material located between the payload volume and a respective one of the layers of the second phase change material.

18. The thermal storage system as defined in claim 17, wherein the enclosed volume of the thermally insulated storage container has a first end and a second end with a larger dimension than the first end such that the payload container and the phase change packs fit within the enclosed volume only when the stack is arranged with the first phase change pack at the first end and the second phase change pack at the second end.

19. The thermal storage system as defined in claim 18, wherein each of the phase change packs also has a first end and a second end with a larger dimension than the first end such that the stack will not fit in the enclosed volume of the thermally insulated storage container if one or both of the phase changes packs is oriented with the respective layer of the second phase change material between the payload volume and the respective layer of the first phase change material.

20. A thermally insulated storage container comprising one or more walls that together define an enclosed volume;

a payload container sized to fit within the enclosed volume, the payload container comprising a payload volume adapted to retrievably house a temperature sensitive payload having a target temperature range;

wherein the payload container comprises a housing that defines the payload volume and a cavity in which a layer of phase change material is contained, the housing comprising an inspection window through which the layer of phase change material is visible, and wherein an indicia located inside the cavity and on an opposite side of the cavity from the inspection window, whereby the indicia is visible through the inspection window when the phase change material is liquid and not visible through the inspection window when the phase change material is solid.

* * * * *